US006913054B2

(12) United States Patent
Miller et al.

(10) Patent No.: US 6,913,054 B2
(45) Date of Patent: Jul. 5, 2005

(54) ENVELOPE FLAP MOISTENING APPARATUS

(75) Inventors: John P. Miller, Shelton, CT (US); Michael M. Chen, Middletown, CT (US); John V. Evans, Brookfield, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 10/660,240

(22) Filed: Sep. 11, 2003

(65) Prior Publication Data

US 2005/0056372 A1 Mar. 17, 2005

(51) Int. Cl.[7] ..... B05B 1/32; B43M 11/00

(52) U.S. Cl. ..... 156/357; 156/442.2; 156/442.4; 156/441.5; 347/14; 118/684

(58) Field of Search ..... 156/356, 355, 156/357, 441.5, 442.1, 442.2, 442.3, 442.4, 442, 570; 118/315, 314, 305, 712, 684, 685, 683, 713; 347/14, 12, 13

(56) References Cited

U.S. PATENT DOCUMENTS 3,911,862 A 10/1975 Lupkas
4,730,197 A * 3/1988 Raman et al. ..... 347/40
5,007,371 A 4/1991 O'Dea et al.
5,252,353 A 10/1993 DiGiulio et al.
5,840,123 A 11/1998 Holbrook
6,193,825 B1 * 2/2001 Dolan ..... 156/64
6,361,603 B1 3/2002 Salomon
2003/0136337 A1 7/2003 Gregoire et al. ..... 118/300

* cited by examiner

*Primary Examiner*—J. A. Lorengo
*Assistant Examiner*—George Koch
(74) *Attorney, Agent, or Firm*—Brian A. Lemm; Angelo N. Chaclas

(57) ABSTRACT

A device for moistening an envelope flap includes a mechanism which defines an envelope feed path and a plate disposed adjacent the envelope feed path. The plate passes between the envelope body and the envelope flap. A plurality of orifices formed in the plate discharge moistening fluid received from a reservoir onto the envelope flap. The moistening device also includes a valve mechanism to selectively supply each of the orifices with moistening fluid from the reservoir. A flap sensing mechanism is disposed adjacent the envelope feed path for sensing an edge portion of the envelope flap and operatively connected to the valve mechanism to supply signals to the valve mechanism to selectively actuate the valve mechanism to selectively supply moistening fluid to the orifices in response to the sensing of the edge portion of the envelope flap.

17 Claims, 5 Drawing Sheets

ENVELOPE FLAP MOISTENING APPARATUS

BACKGROUND

This invention relates generally to the field of mailing machines, and more particularly to a component of a mailing machine that moistens flaps of envelopes to be sealed by the mailing machine.

Generally, a mailpiece transport on a mailing machine transports envelopes and other mailpieces along a feed path so that various functions may be performed on the mailpiece at different locations along the feed path. For example, at one location along the feed path the mailpiece may be weighed, at another location the mailpiece may be sealed, and at a further location an indicia for postage may be applied to the mailpiece. Drive rollers and/or drive belts may be employed to contact the mailpiece to propel the mailpiece along the feed path.

The step of sealing a mailpiece may be considered to include three sub-steps: (a) "stripping" the envelope flap (i.e., opening the flap so that moisture can be applied to the flap), (b) moistening the gummed portion of the flap, and (c) closing the flap and applying pressure to the envelope and flap so that the moistened gummed portion of the flap adheres to the body of the envelope. Known mailing machines include a sealing module that includes devices or sub-modules for performing each of these sub-steps.

Envelope flap moistening sub-modules have been found to exhibit certain problems. Some flap moisteners employ a brush or piece of felt that is moistened by a wick that draws fluid to the brush or felt from a reservoir. It can be problematic with such moisteners to assure that the brush or felt is wetted to a suitable degree. Too much wetting of the brush or felt may cause too much moisture to be deposited on the envelope, which may adversely affect printing on the envelope, alter the appearance of the envelope, or damage the contents of the envelope. Too little wetting of the brush or felt may cause the gummed portion of the envelope flap to be insufficiently moistened, resulting in unreliable sealing. Maintaining a constant degree of wetting of the brush or felt over time also presents difficulties; for example, the amount of fluid transferred to the brush or felt from the wick may vary with the amount of fluid in the reservoir. While moistening a sequence of envelope flaps, or even during the course of moistening a single flap, the brush or felt may dry out to such an extent that inadequate moistening of a flap or a portion of a flap occurs.

There may also be an issue concerning adhesive transfer from the envelope flaps to the brush or felt, possibly leading to build-up of adhesive on the brush or flap, and a need to frequently clean or replace the brush or felt.

In another type of flap moistener, a movable spray nozzle is provided to spray moistening fluid on the gummed portion of the flap. Sensors are provided to detect the edge of the flap, and the spray nozzle is moved to follow the gummed portion of the flap based on output from the sensors. Moistening fluid is continuously dispensed from the nozzle.

Because of inherent delays in moving the spray nozzle, the sensors may need to be placed considerably upstream in the envelope feed path, thereby leading to a relatively large footprint for the moistening device. In addition, the envelope may shift transversely over the relatively long distance from the sensors to the nozzle, so that the gummed portion of the flap may not be accurately tracked by the nozzle.

Furthermore, delay in moving the nozzle may cause leading and trailing portions of the gummed portion of the flap to be missed by the spray. This may result in unreliable sealing. It may also be difficult for the nozzle to be moved to follow certain flap profiles, such as rectangular or pointed flap profiles. This too may result in unreliable sealing. Changes in direction by the nozzle may cause fluctuation in pressure in the moistening fluid, preventing the stream of fluid from being reliably directed to the gummed portion of the label. Again unreliable sealing may result.

The requirement that the nozzle sometimes be accelerated quickly to follow the flap contour may make significant demands on the power supply for the motor that moves the nozzle. The motor may also be a source of noise that may disturb the operator of the mailing machine. Also, the continuous flow of moistening fluid must be collected and recirculated, causing the flap moistener to be rather complex in its construction. In addition, recirculated fluid may be contaminated with paper dust and/or adhesive from the envelope flap, which may lead to clogging of nozzles, pump, tubing and/or filters.

Another disadvantage of the continuously flowing fluid is that if the mailing machine happens to stop with an envelope at the moistening station, a very excessive amount of moisture may be directed to the envelope.

U.S. Pat. No. 3,911,862 discloses an envelope flap moistening apparatus in which one movable or two or more stationary nozzles are operated responsively to envelope sensors to spray strips of moistening fluid on the gummed portion of the envelope flap. Specifically, the '862 patent requires the envelope flap to be opened no less than 90° from the envelope body such that the envelope flap is perpendicular to the envelope body. Nozzles located adjacent to the envelope body then spray moistening fluid onto the gummed portion of the envelope flap. There are several disadvantages with this type of arrangement. First, the amount of space needed to accommodate the moistening apparatus, including the nozzles, is large, since the nozzles must be situated adjacent to the envelope body. Another disadvantage is the length of the envelope feed path necessary to perform the moistening and sealing functions. There must be a sufficient distance between the envelope flap opening device, typically referred to as a stripper blade, and the nozzle location to ensure that the envelop flap has been opened to the required right angle with the envelope body. If the envelope flap is not at a right angle to the envelope body, the moistening fluid will not be sprayed on the gummed portion. If the moistening fluid is not sprayed on the gummed portion, the envelope may not properly seal. There also needs to be a sufficient distance between the nozzles and a sealing nip to allow the envelope flap to move from the open position, i.e., a perpendicular position with respect to the envelope body, to a closed position before passing through the sealing nip. If the distance between the nozzles and the sealing nip is insufficient, buckling of the envelope flap can occur, thereby resulting in improper sealing of the envelope, or jamming of the envelope along the transport mechanism. Either of these results can cause dissatisfaction with the moistening apparatus. Thus, to ensure proper moistening and sealing, the device in the '862 patent requires a significant amount of distance from end to end, thereby increasing the overall length of a mailing machine in which the apparatus is installed. There exists a need, therefore, for a moistening apparatus that is more compact and has a minimal end-to-end distance, thereby fitting more conveniently within a mailing machine than the apparatus disclosed in the '862 patent, while still ensuring proper moistening and sealing of envelopes.

SUMMARY

Accordingly, an improved envelope flap moistening mechanism for a mailing machine is provided. An improved device for moistening an envelope flap includes a mechanism and associated structure defining an envelope feed path, a plate disposed adjacent the envelope feed path, and a reservoir containing an envelope flap moistening fluid. As an envelope is transported through the moistening mechanism, the envelope body will pass over the top of the plate while the envelope flap will pass beneath the plate. Thus, the amount of separation required between the envelope flap and the envelope body is significantly reduced. The moistening device further includes a plurality of orifices formed in the plate for discharging a moistening fluid onto the envelope flap as it passes. The moistening fluid can be received from the reservoir and a valve mechanism connected between the reservoir and the orifices for selectively supplying each of the orifices with moistening fluid from the reservoir. The moistening device also includes a flap sensing mechanism disposed adjacent the envelope feed path for sensing an edge portion of the envelope flap and operatively connected to the valve mechanism for supplying signals to the valve mechanism for selectively actuating the valve mechanism to selectively supply moistening fluid to the orifices in response to the sensing of the edge portion of the envelope flap.

The orifices may be arranged in a first substantially linear array. The valve mechanism may include a plurality of valves each controlling a respective fluid path and each fluid path may be in fluid communication with at least one of the orifices. The sensing mechanism may include a like plurality of sensors (i.e., the same number of sensors as valves, in some embodiments), the sensors being arranged in a second substantially linear array and positioned adjacent the envelope feed path upstream relative to the first linear array, the sensors being operative to control the valves.

In some embodiments, the plurality of valves may include at least six valves and the plurality of sensors may include at least six sensors. In some embodiments, each fluid path may be in fluid communication with a respective pair of the orifices.

In another aspect of the invention, a device for moistening an envelope flap includes a mechanism defining an envelope flap feed path, a mechanism for moving the envelope flap along the feed path and past a spray moistening mechanism, with the flap in a substantially horizontal orientation, and a spray moistening mechanism disposed adjacent the envelope flap feed path for spraying moisture in a substantially vertical direction in strip segments to a gummed surface of the flap as the flap moves past the moistening mechanism. The moistening mechanism applies moisture to the flap in tiered segmented strips so as to substantially cover most of the gummed surface of the flap with moisture, as the envelope flap moves past.

The substantially vertical direction may be a substantially downward direction. The spray moistening mechanism may include a first horizontal plate having a plurality of orifices formed therethrough and a plurality of first fluid channels formed along the first plate and each of the first fluid channels being in fluid communication with at least a respective one of the orifices. The orifices are for discharging the moisture to the envelope flap, and may be arranged in a substantially linear array. The spray moistening mechanism may also include a second horizontal plate mounted on the first plate and having a plurality of second fluid channels formed along the second plate and each in fluid communication with at least a respective one of the orifices. The spray moistening mechanism may also include a circuit board mounted on the second plate.

According to still another aspect of the invention, a method of moistening an envelope flap includes transporting an envelope along an envelope feed path with a flap of the envelope substantially horizontally oriented, sensing an edge of the flap, and selectively actuating valves from among a plurality of valves to downwardly spray a moistening fluid on a gummed portion of the flap as the envelope is transported along the envelope feed path.

According to yet another aspect of the invention, an envelope flap moistening assembly includes a first horizontal plate having a plurality of orifices formed therethrough, a second horizontal plate mounted on the first horizontal plate, a horizontal circuit board mounted on the second horizontal plate, a plurality of sensors mounted on an underside of the circuit board, and a plurality of valves, each mounted on the circuit board or mounted on the first horizontal plate. The envelope moistening assembly may further include circuitry on the circuit board operatively connected to the sensors and to the valves for selectively actuating the valves in response to the sensors sensing an edge of an envelope flap. The orifices may be arranged in a first substantially linear array and the sensors may be arranged in a second substantially linear array, with the second array parallel to and horizontally and vertically offset from the first array.

Therefore, it should now be apparent that the invention substantially achieves all the above aspects and advantages. Additional aspects and advantages of the invention will be set forth in the description that follows, and in part will be obvious from the description, or may be learned by practice of the invention. Various features and embodiments are further described in the following figures, description and claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION

An envelope flap moistening device of the present invention is highly compact and space efficient and sprays controlled jets of moistening fluid on a gummed portion of the envelope flap, in response to sensors that detect the edge of the envelope flap. The moistening device of the present invention requires only a minimal separation between the envelope flap and the envelope body, thereby decreasing the amount of distance required to open the flap and then subsequently close the flap (after moistening).

Figure 1:
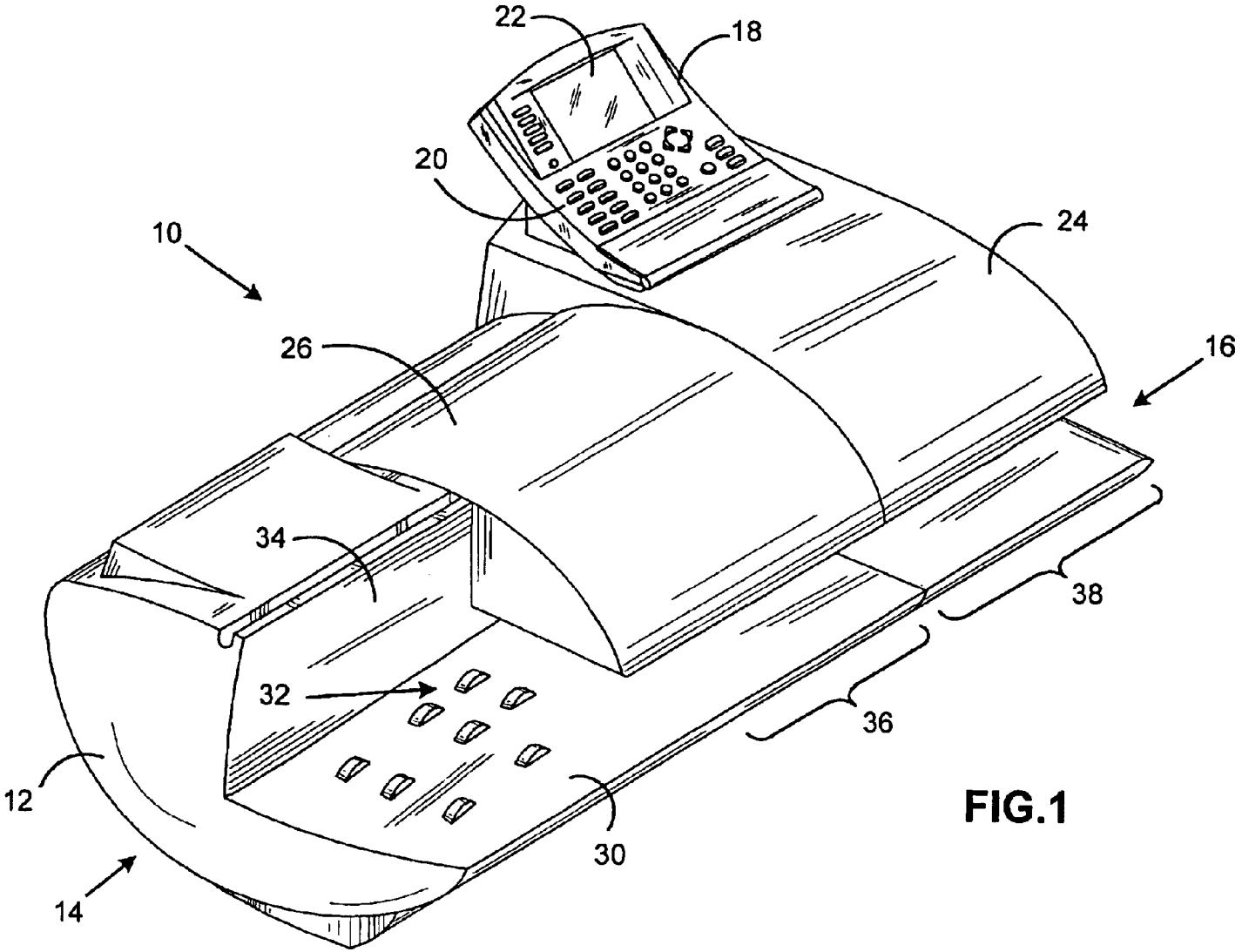
FIG. 1 is a perspective view of a typical mailing machine constructed and arranged in accordance with the principles of the present invention.

Referring now to the drawings, and particularly to FIG. 1, the reference numeral 10 indicates generally a typical mailing machine which incorporates the principles of the present invention. The mailing machine 10 includes a base unit generally designated by the reference numeral 12. The base unit 12 has an envelope infeed end, generally designated by the reference numeral 14 and an envelope outfeed end, designated generally by the reference numeral 16. A control unit 18 is mounted on the base unit 12, and includes one or more input/output devices, such as, for example, a keyboard 20 and a display device 22.

Cover members 24, 26 are pivotally mounted on the base 12 and are moveable between a closed position shown in FIG. 1 and an open position (not shown). In the open position of the cover members 24, 26, various operating components and parts are exposed for service and/or repair as needed. A mailpiece transport mechanism which is not visible in FIG. 1 is housed under the cover members 24, 26. An envelope flap moistening device in accordance with principles of the present invention is described below and is housed under the cover member 26.

The base unit 12 further includes a generally horizontal feed deck 30 which extends substantially from the infeed end 14 to the outfeed end 16. A plurality of nudger rollers 32 are suitably mounted under the feed deck 30 and project upwardly through openings in the feed deck so that the rollers 32 can exert a forward feeding force on a succession of mailpieces placed in the infeed end 14. A vertical wall 34 defines a mailpiece stacking location from which the mailpieces are fed by the nudger rollers 32 along the feed deck 30 and into the transport mechanism referred to above. The transport mechanism transports the mailpieces through one or more modules, such as, for example, a separator module and moistening/sealing module including an envelope flap moistening device in accordance with principles of the invention. Each of these modules is located generally in the area indicated by reference numeral 36. The mailpieces are then passed to a metering/printing module located generally in the area indicated by reference numeral 38.

Figure 2:
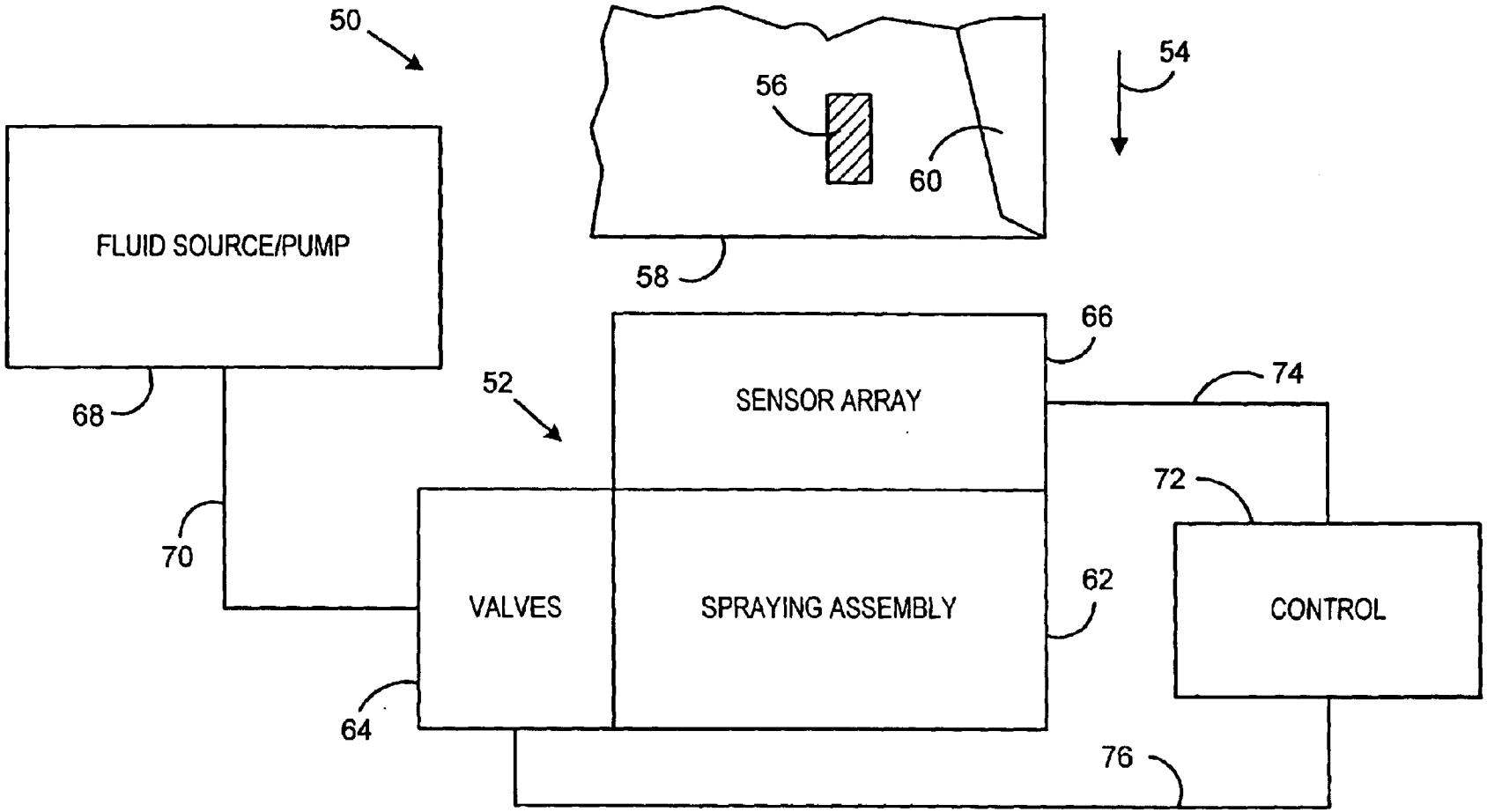
FIG. 2 is a schematic block diagram representation of an envelope flap moistening device that is part of the mailing machine of FIG. 1.

FIG. 2 is a block diagram representation of an envelope flap moistening device 50 in accordance with the present invention. The envelope flap moistening device 50 includes an envelope flap moistening assembly generally indicated at 52. The envelope flap moistening assembly is positioned adjacent an envelope feed path represented by an arrow 54. The envelope feed path 54 may be defined in part by the feed deck 30 shown in FIG. 1, which is not separately indicated in FIG. 2. Also serving to define the envelope feed path are one or more conventional envelope transport elements (of which one is schematically represented at 56 in FIG. 2). In accordance with conventional practices, the envelope transport elements may include either or both of an envelope drive roller forming a drive nip with a pressure roller, and a drive belt mounted in opposition to a plurality of pressure rollers. Also partially shown in FIG. 2 is an envelope 58 having a flap 60 that is to be moistened.

The envelope flap moistening assembly 52, which will be described in more detail in connection with succeeding drawings, includes a spraying assembly 62, valves 64 for controlling dispensing of moistening fluid from orifices of the spraying assembly, and a sensor array 66 for detecting an edge of the envelope flap 60. The sensor array 66 is located upstream along the envelope feed path 54 relative to the orifices (not separately shown in FIG. 2) of the spraying assembly 62.

The envelope flap moistening device 50 also includes a fluid source or reservoir, and a fluid pump, which are together indicated by a block 68. The fluid source stores a quantity of flap moistening fluid (e.g., water) which is supplied under constant pressure from the pump over a fluid line 70 to the valves 64. The pump may be, for example, a continuous pump. The fluid source and pump may be provided in accordance with conventional practices. Alternatively, the pump may be integral with the flap moistening assembly 52.

The envelope flap moistening device 50 further includes control circuitry 72. As will be seen, the control circuitry 72 may be physically mounted on the envelope flap moistening assembly 52, although the control circuitry 72 is shown separately from the flap moistening assembly 52 in FIG. 2. The control circuitry 72 is connected to the sensors (not separately shown in FIG. 2) of the sensor array 66 via signal paths 74 to receive flap edge detection signals from the sensors. The control circuitry 72 is also connected to the valves 64 via signal paths 76 to allow the control circuitry 72 to provide control signals to the valves 64.

Figure 3:
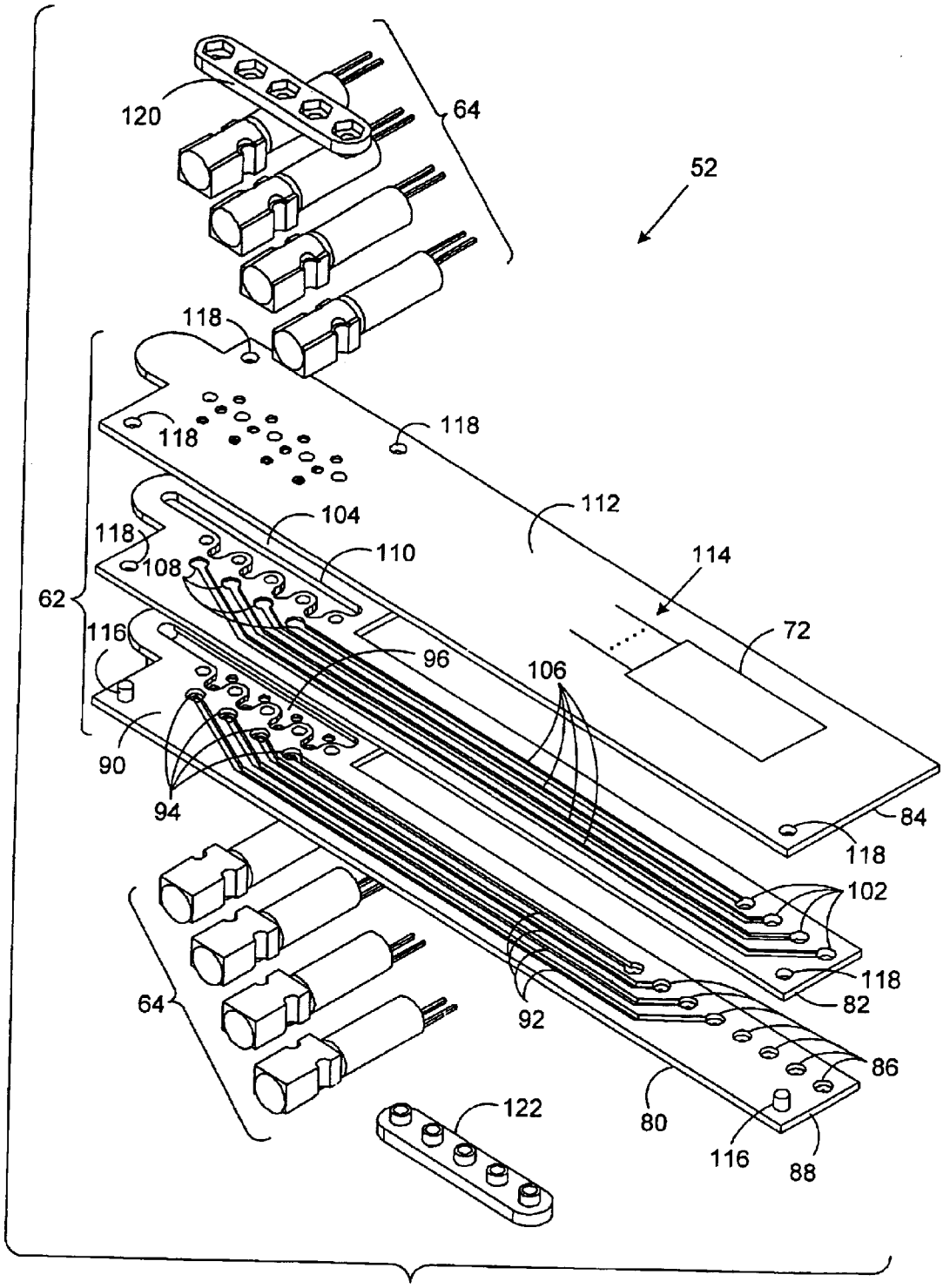
FIG. 3 is an exploded view of an envelope flap moistening assembly that is part of the moistening device of FIG. 2.
Figure 4:
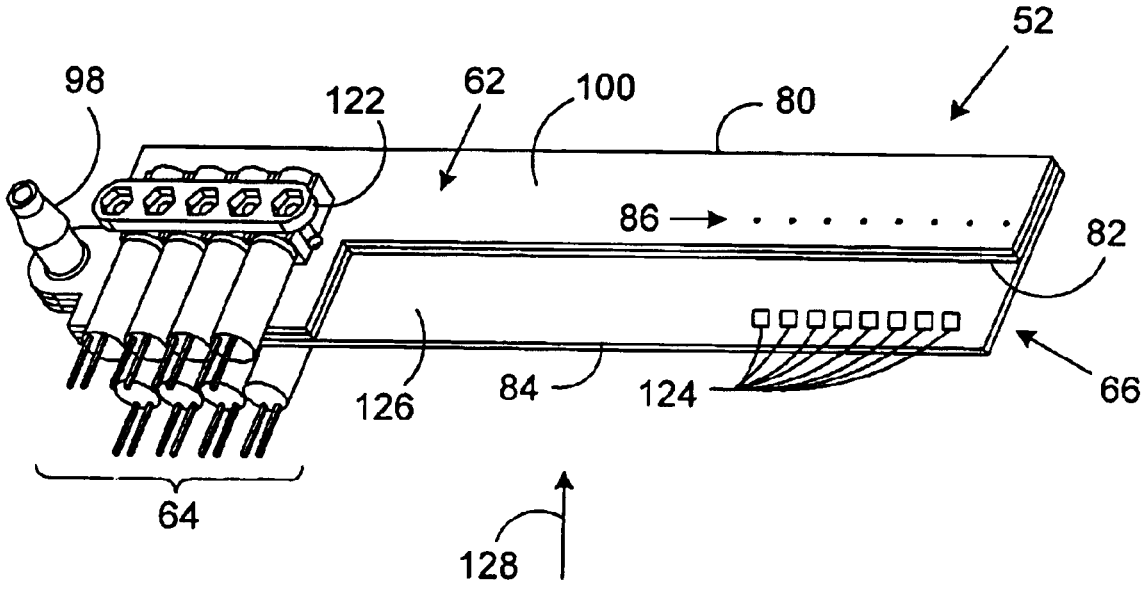
FIG. 4 is an isometric view of the envelope flap moistening assembly of FIG. 3, taken from below.

FIG. 3 is an exploded view of the envelope flap moistening assembly 52, and FIG. 4 is an isometric view, taken from below, of the moistening assembly in an assembled condition. The envelope flap moistening assembly 52 includes a first (lower) plate 80, a second (middle) plate 82 and a circuit board 84 that functions as a top plate. The plates 80, 82 and circuit board 84 may be considered to constitute the spraying assembly 62 referred to in connection with FIG. 2. As best seen in FIG. 3, a plurality of orifices 86 (eight in all in the particular embodiment shown in FIGS. 3 and 4) are formed through the lower plate 80. It should be understood, of course, that any number of orifices could be provided. The orifices 86 (also visible in FIG. 4) are arranged in a substantially linear array that extends in a lengthwise direction of the lower plate 80 starting from an outboard end 88 of the lower plate 80. The orifices 86 serve as openings for dispensing moistening fluid to the envelope flap.

Also formed in the lower plate 80, and in particular in an upper surface 90 thereof, are a plurality of fluid channels 92. Each fluid channel 92 extends along the lengthwise direction of the lower plate 80 from a respective channel inlet 94 to a respective one of the orifices 86. In one embodiment as illustrated, there are four fluid channels 92 formed in the lower plate 80, each respectively in fluid communication with one of the four inboard orifices 86. In addition, a manifold recess 96 is formed in the upper surface 90 of the lower plate 80 adjacent the channel inlets 94. An assembly inlet 98 (FIG. 4) is provided extending downwardly from a lower surface 100 of the lower plate 80 and is in fluid communication with the manifold recess 96. The assembly inlet 98 is in fluid communication with the fluid source 68 (FIG. 2) via the fluid line 70 (FIG. 2, not shown in FIG. 4).

Referring again to FIG. 3, a plurality of orifices 102 (four in the particular embodiment shown) are formed through the middle plate 82 at locations that correspond to four outboard orifices 86 in the lower plate 80. Also formed in the middle plate 82, and in particular in an upper surface 104 of the middle plate 82, are a plurality of fluid channels 106. Each fluid channel 106 extends along the lengthwise direction of the middle plate 82 from a respective channel inlet 108 to a respective one of the orifices 102. In one embodiment as illustrated, there are four fluid channels 106 formed in the middle plate 82 (although more or less may be provided), each respectively in fluid communication with one of the four orifices 102, and via those orifices, with one of the four outboard orifices 86 of the lower plate 80.

In addition, a manifold cut-out 110 is formed in the middle plate 82. The manifold cut-out 110 is adjacent the channel inlets 108 and is positioned and shaped to correspond to the manifold recess 96 in the upper surface 90 of the lower plate 80. When the spraying assembly 62 is in its assembled condition shown in FIG. 4, the manifold recess 96 of the lower plate 80 and the manifold cutout 110 of the middle plate 82 combine to form a manifold within the spraying assembly 62.

In some other embodiments, the fluid channels 106 may be in fluid communication not with the outboard orifices 86 but rather with the inboard orifices 86, and the fluid channels 92 may be in fluid communication not with the inboard orifices 86 but rather with the outboard orifices 86.

FIGS. 3 and 4 also show the valves 64 which are part of the spraying assembly 62. In the particular embodiment shown in those drawings, there are eight valves in all, of which four are mounted on an upper surface 112 of the circuit board 84 and four are mounted on the lower surface 100 of the lower plate 80. Each of the valves 64 mounted on the upper surface 112 of the circuit board 84 controls a respective one of the fluid paths 106 (FIG. 3), and consequently controls discharging of moistening fluid from a respective one of the four outboard orifices 86. Each of the valves 64 mounted on the lower surface 100 of the lower plate 80 controls a respective one of the fluid paths 92 and consequently controls discharging of moistening fluid from a respective one of the four inboard orifices 86. Each valve 64 may be actuatable between a first position in which no fluid communication path is provided between the manifold and a corresponding one of the channel inlets 94 or 108 and a second position in which a fluid communication path is provided between the manifold and the corresponding one of the channel inlets. Actuation of the valves 64 is performed in response to control signals provided by the control circuitry 72. In one embodiment the valves 64 may be model LHDA 2421311H valves available from Lee Company, Westbrook, Conn.

FIG. 3 also shows, somewhat schematically, the control circuitry 72 mounted on the upper surface 112 of the circuit board 84. Also partially and somewhat schematically shown are signal traces 114 which provide at least part of the signal paths 76 from the control circuitry 72 to the valves 64.

The lower plate 80 also has assembly pins 116 extending upwardly at corners of the upper surface 90 of the lower plate 80. The pins 116 cooperate with apertures 118 in the middle plate 82 and in the circuit board 84 to aid in securing the plates 80, 82 and the circuit board 84 together when the spraying assembly 62 is in its assembled condition shown in FIG. 4. The envelope flap moistening assembly 52 also includes upper and lower mounting yokes 120, 122 to aid in mounting the valves 64 on the spraying assembly 62.

Referring once more to FIG. 4, the sensor array 66 may include sensors 124 arranged in a linear array and mounted on a lower surface 126 of the circuit board 84. In one embodiment, the sensor array may include eight sensors, as shown in FIG. 4, but more or less sensors can be provided. The linear array in which the sensors 124 are arranged may be parallel to the array of orifices 86 and may be positioned adjacent the envelope feed path upstream relative to the array of orifices 86. The sensor array 66 may be horizontally and vertically offset from the array of orifices 86. The direction of envelope transport is indicated by an arrow 128 in FIG. 4. As seen from FIG. 4, each of the sensors 124 may be positioned directly upstream from a corresponding one of the orifices 86. Signal traces, which are not shown, may be provided to connect each of the sensors 124 with the control circuitry 72 (FIGS. 2 and 3). Discharging of moistening fluid from each of the orifices 86 may be controlled on the basis of a signal or signals provided from the corresponding sensor 124 based on the sensor's detecting the edge of the envelope flap.

Figure 5:
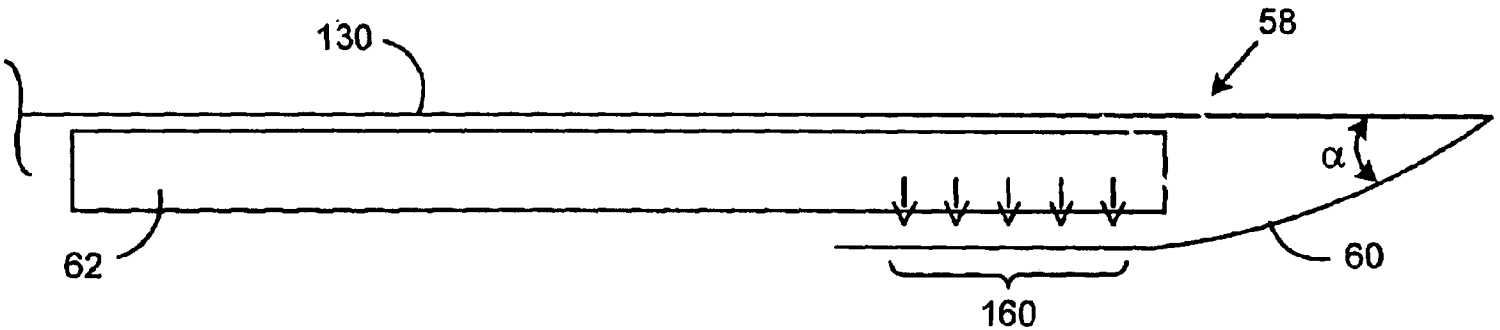
FIG. 5 is a schematic side view showing the envelope flap moistening assembly of FIGS. 3 and 4 applying moistening fluid to an envelope flap.

Referring now to FIG. 5, in operation, an envelope 58 is fed with the flap side down toward the envelope flap moistening device 50. The envelope 58 is transported by one or more envelope transport elements 56 (FIG. 2) along the envelope feed path toward the spraying assembly 62, which may function as a stripper blade to separate the flap 60 from the body 130 of the envelope 58 to a sufficient extent such that the flap 60 may pass beneath the spraying assembly 62 while the body 130 of the envelope 58 passes above the spraying assembly 62. Alternatively, a stripper blade or other flap-separating structure may be provided separately from the spraying assembly 62 upstream from the spraying assembly 62. As illustrated in FIG. 5, the envelope flap 60 needs only to be opened a sufficient amount such that the spraying assembly 62 can pass between the envelope body 130 and the envelope flap 60. Because of the very low profile of the spraying assembly 62, the distance the envelope flap 60 needs to be opened is very small. For example, the height of the spraying assembly 62 is approximately 3/16 of an inch. This small distance provides significant advantages over conventional moistening systems that required the envelope flap to be opened approximately 90° from the envelope body. As illustrated in FIG. 5, the angle $\alpha$ formed between the envelope body 130 and the flap 60 is substantially less than 90°, and need not be more than approximately 30°. This small separation distance can allow for at least a portion 160 of the flap 60 of the envelope 58 to be substantially horizontally oriented as it passes beneath the spraying assembly 62. The significant decrease in the opening distance of the envelope flap according to the present invention allows the envelope flap to move from a closed position, when inserted into the mailing machine, to an open position to pass by the spraying assembly 62, and back to the closed position for passing through a sealing nip in a minimal amount of distance, thereby allowing the overall length of the mailing machine 10 to be minimized.

Figure 6:
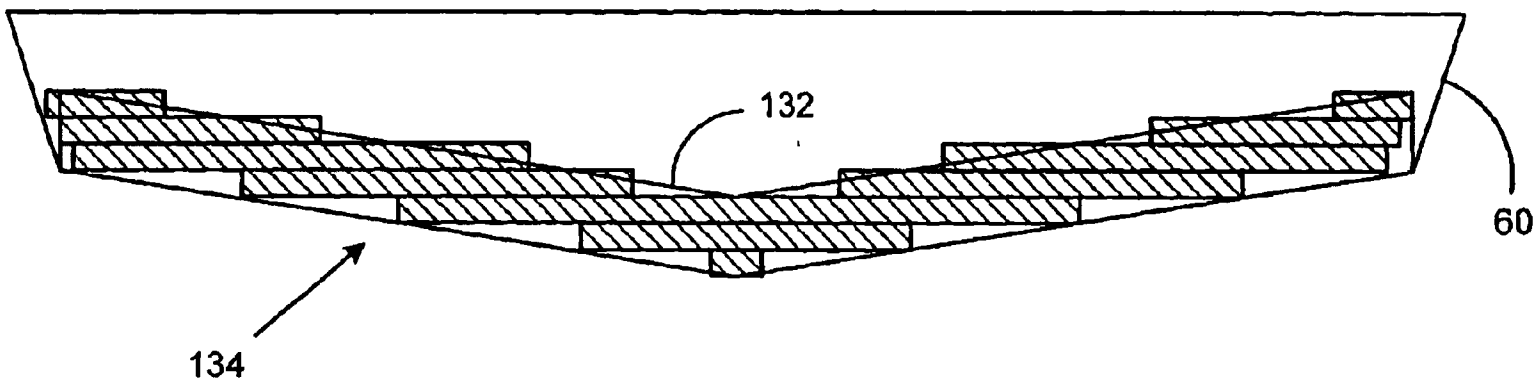
FIG. 6 illustrates an envelope flap showing strips of moistening fluid applied to the envelope flap.

One or more of the sensors 124 (FIG. 4) sense an edge of the flap 60 of the envelope 58 and provide a signal or signals to the control circuitry 72 to indicate sensing of the flap edge. In response to the sensor signal or signals, the control circuitry 72 may actuate one or more of the valves 64 to allow moistening fluid to be sprayed from one or more of the orifices 86 to the flap 60 of the envelope 58. Each valve 64 that is actuated to allow discharging of the moistening fluid may correspond to (i.e., control the fluid channel 92 or 106 that leads to) an orifice 86 that corresponds to (i.e., is directly downstream from) a sensor 124 that sent a signal to the control circuitry 72. The valves 64 may be actuated in such a manner, in response to signals from the sensors 124, that the moistening fluid is sprayed to a gummed surface 132 (FIG. 6) of the envelope flap 60 in strip segments 134 (shown as shaded in FIG. 6), forming tiered segmented strips that substantially cover most of the gummed surface 132, as the envelope flap moves past (below) the orifices 86 of the spraying assembly 62. In the example strip pattern shown in FIG. 6, virtually all of the moistening fluid is sprayed onto the envelope flap, so that recirculation of fluid may not be necessary. Alternatively, more aggressive or less aggressive spray patterns may be employed.

With the gummed surface 134 substantially completely moistened by the moisture sprayed from the spraying assembly 62, the envelope 58 may next be fed through a sealing nip (e.g., in accordance with conventional practices) to seal the envelope. The envelope may then be transported through the balance of the area 36 (FIG. 1), and through area 38 for printing, and then may be ejected from the outfeed end 16 of the mailing machine 10.

In some embodiments, there may be only six valves, six fluid channels and six nozzle orifices, rather than the eight valves, eight fluid channels and eight nozzle orifices shown in the drawings. Alternatively, a larger or smaller number or valves, fluid channels and nozzle orifices may be present. For example, in some other embodiments, there may be 12 valves, 12 fluid channels and 12 pairs of nozzle orifices (24 nozzle orifices in all) with each of the fluid channels in fluid communication with the two orifices of a respective pair of orifices. In some embodiments, the 24 nozzle orifices may each be 0.013 inch in diameter and there may be a pitch among the orifices of 0.140 inch (e.g., the distance between the two orifices of a pair may be 0.140 inch, and the center-to-center distance between adjacent pairs of orifices may be 0.280 inch). The furthest outboard orifice may be approximately 4 inches from the outboard end of the nozzle assembly.

The horizontal distance between the sensor array and orifice array may be about ⅝ inch. The envelope flap moistening device may have a response time (time from sensing envelope flap edge to dispensing of moistening fluid) of about 8 msec, of which about 4 msec may correspond to the valve response time.

In some embodiments, the valves may be mounted transversely to the envelope feed direction, rather than being mounted parallel to the envelope feed direction as shown in the drawings.

In some embodiments, fluid channels may be formed both on the top and bottom of the middle plate, or on the bottom of the circuit board and on the bottom of the middle plate. Other combinations are possible. For example, a lower set of fluid channels may be formed in combination by recesses on the upper surface of the lower plate and the lower surface of the middle plate, and an upper set of fluid channels may be formed in combination by recesses on the upper surface of the middle plate and the lower surface of the circuit board. It should be understood that it is not required that the nozzle assembly be formed of a lower plate, a middle plate and a circuit board on top of the middle plate.

The envelope flap moistening device may solve a number of problems that may be associated with previously proposed moistening devices. For example, if the envelope is passed through the mailing machine in a horizontal orientation, i.e., laying on a side, the moistening fluid will be sprayed in a direction that is substantially vertically downwardly. With the moistening fluid sprayed in this direction, it may be possible to avoid misdirection of the fluid that may occur with horizontal spraying in the event of variations in fluid pressure. It should be understood, of course, that while the invention was described and illustrated with the envelope being horizontally situated and the moistening fluid being sprayed in a substantially downward vertical direction, the present invention is not so limited and can be utilized for any orientation of an envelope. For example, the envelope may be processed standing on its bottom (or top) edge, with the spraying assembly 62 in a vertical direction such that the moistening fluid is sprayed in a substantially horizontal direction.

Another problem that may be associated with previously proposed moistening devices solved by the present invention is that a faster response time and more accurate spraying may be provided by the moistening device of the present invention as compared to a moistening device which employs a moving nozzle. In general, the moistening device of the present invention may tend to reduce or eliminate excessive wetting of envelopes, which in conventional devices may lead to several envelopes adhering to each other. Power consumption, variations in fluid pressure, moistening device footprint, and operating noise may all be reduced by eliminating the moving nozzle. Reliability of the moistening device may also be enhanced by the relatively small number of moving parts. In addition, the transport mechanism of the mailing machine may be stopped with an envelope present in the moistening device without exposing the envelope to excessive moistening, assuming that all valves are shut off at the same time the transport mechanism is stopped.

A number of embodiments of the present invention have been described. Nevertheless, it will be understood that various modifications may be made without departing from the spirit and scope of the invention. Accordingly, other embodiments are within the scope of the following claims.

What is claimed is:

1. A device for moistening an envelope flap of an envelope, comprising:

a first plate having a first set of orifices formed therethrough for discharging moistening fluid;

a second plate, mounted on said first plate, having a second set of orifices formed therethrough, a portion of said second set of orifices aligning with at least a portion of said first set of orifices in said first plate;

a circuit board mounted on said second plate;

a plurality of valves mounted on said circuit board and said first plate, each of said plurality of valves being connected to a respective one of said first and second set of orifices for selectively supplying each of the orifices with moistening fluid; and flap sensing means mounted on said circuit board for sensing an edge portion of said envelope flap, and operatively connected to said plurality of valves for supplying signals to said plurality of valves for selectively actuating each of said plurality of valves to selectively supply moistening fluid to said first and second sets of orifices in response to the sensing of the edge portion of said envelope flap.

2. The device according to claim 1, wherein said first set of orifices are arranged in a first substantially linear array.

3. The device according to claim 2, further comprising;

a plurality of fluid paths formed in said first and second plates, each of said plurality of valves controlling a respective fluid path, each fluid path in fluid communication with at least one of said first and second set of orifices, wherein the sensing means includes a plurality of sensors arranged in a second substantially linear array that is parallel to the first linear array and positioned upstream relative to the first linear array, the sensors being operative to control said valves, the plurality of sensors being like in number to the plurality of valves.

4. The device according to claim 3, wherein the plurality of valves includes at least six valves and the plurality of sensors includes at least six sensors.

5. The device according to claim 3, wherein each fluid path is in fluid communication with a respective pair of said first and second set of orifices.

6. An envelope flap moistening assembly, comprising:

a first horizontal plate having a plurality of orifices formed therethrough;

a second horizontal plate mounted on the first horizontal plate;

a horizontal circuit board mounted on the second horizontal plate;

a plurality of sensors mounted on an underside of said circuit board; and a plurality of valves, each mounted on said circuit board or mounted on said first horizontal plate.

7. The envelope flap moistening assembly according to claim 6, further comprising circuit means on the circuit board operatively connected to the sensors and to the valves for selectively actuating the valves in response to the sensors sensing an edge of an envelope flap.

8. The envelope flap moistening assembly according to claim 6, wherein:

the orifices are arranged in a first substantially linear array; and the sensors are arranged in a second substantially linear array, the second array parallel to and horizontally offset from the first array.

9. The envelope flap moistening assembly according to claim 8, wherein the second array is vertically offset from the first array.

10. The envelope flap moistening assembly according to claim 6, wherein the plurality of valves includes at least six valves.

11. The envelope flap moistening assembly according to claim 6, wherein at least one of the first and second plates has a plurality of fluid channels formed therealong, each of the fluid channels controlled by a respective one of the valves and in fluid communication with at least a respective one of the orifices.

12. The envelope flap moistening assembly according to claim 11, wherein both of the first and second plates have a respective plurality of the fluid channels formed therealong.

13. The envelope flap moistening assembly according to claim 12, wherein the first and second plates and the circuit board are sandwiched together, with a top surface of the first plate in contact with a bottom surface of the second plate, and a top surface of the second plate in contact with a bottom surface of the circuit board.

14. The envelope flap moistening assembly according to claim 6, wherein some of the valves are mounted on the circuit board and some of the valves are mounted on the first horizontal plate.

15. A mailing machine comprising:

an envelope feed path;

a reservoir for holding an envelope flap moistening fluid;

a moistening device disposed along said feed path such that said moistening device passes between an envelope flag and a body of an envelope as said envelope is transported alone said envelope feed path, said moistening device comprising:

a first plate having a first set of orifices formed therethrough for discharging moistening fluid received from said reservoir, said first plate being positioned substantially horizontal with respect to said envelope feed path;

a second plate, mounted on said first plate, having a second set of orifices formed therethrough, a portion of said second set of orifices aligning with at least a portion of said first set of orifices in said first plate;

a circuit board mounted on said second plate;

a plurality of valves mounted on said circuit board and said first plate, each of said plurality of valves being connected between said reservoir and a respective one of said first and second set of orifices for selectively supplying each of the orifices with moistening fluid from said reservoir; and a flap sensing circuit mounted on said circuit board and disposed adjacent said envelope feed path to sense an edge portion of said envelope flap, and operatively connected to said plurality of valves for supplying signals to said plurality of valves for selectively actuating each of said plurality of valves to selectively supply moistening fluid to said first and second sets of orifices in response to the sensing of the edge portion of said envelope flap.

16. The mailing machine according to claim 15, wherein said moistening fluid is discharged in a downward direction.

17. The mailing machine according to claim 15, wherein an angle formed by said envelope flap and said body of said envelope to allow said moistening device to pass between said envelope flap and said body of said envelope is approximately 30° or less.

* * * * *